US005484329A

United States Patent [19]

Engelbrektson

[11] Patent Number: 5,484,329

[45] Date of Patent: Jan. 16, 1996

[54] BOWLING BALL SURFACE FINISHING TOOL ASSEMBLY

[76] Inventor: Terry Engelbrektson, 2931 N. Main St., Walnut Creek, Calif. 94596

[21] Appl. No.: 338,420

[22] Filed: Nov. 14, 1994

[51] Int. Cl.[6] ..... B24D 15/00

[52] U.S. Cl. ..... 451/523; 451/50; 451/540; 473/54

[58] Field of Search ..... 451/50, 523, 490, 451/344, 552, 540, 461, 462, 548, 541, 555, 524, 525; 473/54, 59, 60

[56] References Cited

U.S. PATENT DOCUMENTS

| | | | |
|---|---|---|---|
| 284,548 | 9/1883 | Gwyn | 30/494 |
| 2,140,410 | 12/1938 | Titmus | 88/54 |
| 2,450,433 | 10/1948 | Leeman | 51/305 |
| 3,024,578 | 3/1962 | Mushkin | 51/117 |
| 3,128,580 | 4/1964 | Davis | 451/289 |
| 3,498,008 | 3/1970 | Turner, Jr. | 451/344 |
| 3,583,111 | 6/1971 | Volk | 451/490 |
| 3,769,760 | 11/1973 | Kritske | 451/523 |
| 3,961,448 | 6/1976 | Akahane | 51/117 |
| 3,989,079 | 11/1976 | Treadway | 145/27 |
| 4,594,782 | 6/1986 | Willard | 30/494 |
| 4,617,767 | 10/1986 | Ali | 451/490 |
| 4,785,586 | 11/1988 | Kratfel | 451/344 |
| 4,987,936 | 1/1991 | Calabrese | 144/346 |

FOREIGN PATENT DOCUMENTS

| | | | |
|---|---|---|---|
| 52-37294 | 3/1977 | Japan | 51/289 |

*Primary Examiner*—Robert A. Rose
*Attorney, Agent, or Firm*—John R. Flanagan

[57] ABSTRACT

A tool assembly for finishing a spherical surface of a bowling ball includes a tool having a pliable solid right cylindrical body with concave-shaped depressions formed in opposite faces of the body and a pair of abrasive disks disposed in the depressions. The body is shorter in axial length than in diameter, with the opposite faces thereof being spaced apart by the axial length, and generally parallel to each other. The depressions are centered on the opposite faces and oriented back-to-back. One concave depression has a larger chordal length than the other but both concave depressions have spherical radii similar to that of a bowling ball. The abrasive disks are releasably attached, with hook and loop material, in the concave depressions so as to lie substantially flush against the surfaces of the depressions.

22 Claims, 1 Drawing Sheet

FIG. 1
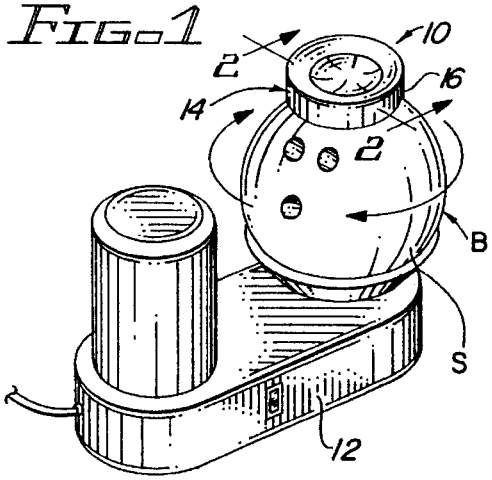
FIG. 3
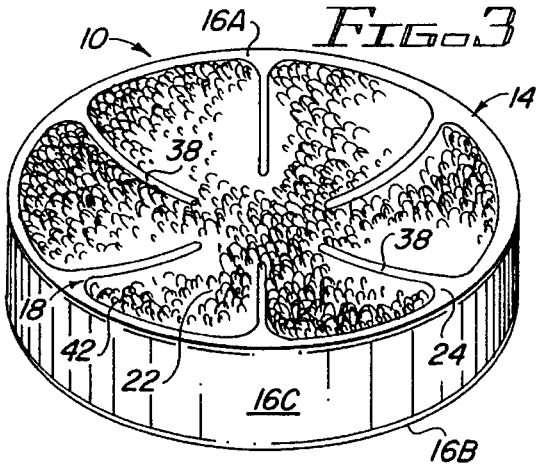
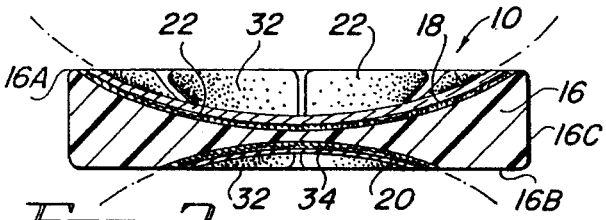
FIG. 2
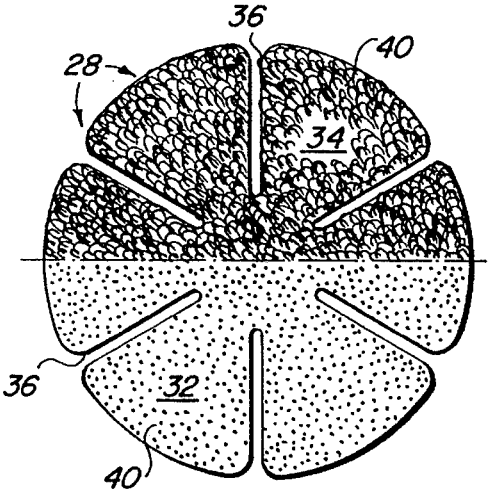
FIG. 6
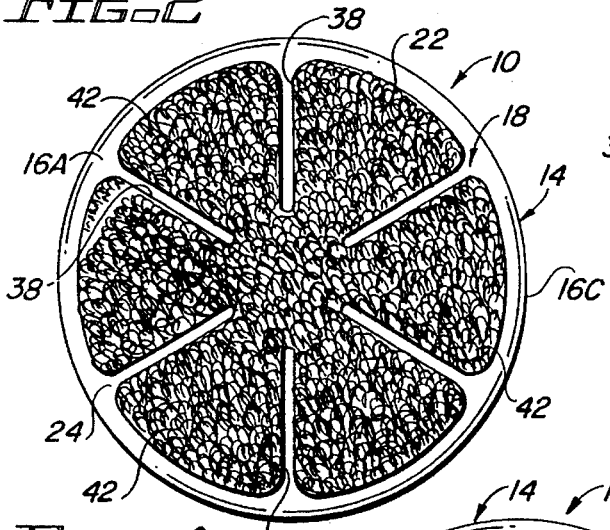
FIG. 4
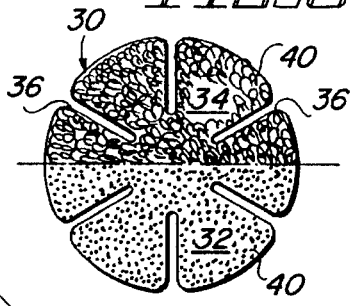
FIG. 7
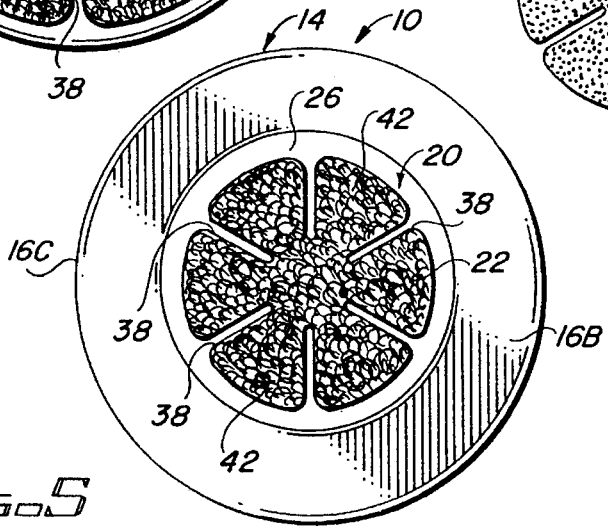
FIG. 5

BOWLING BALL SURFACE FINISHING TOOL ASSEMBLY

BACKGROUND OF THE INVENTION

1. Field of the Invention

The present invention generally relates to contouring, sanding and polishing spherical surfaces, and more particularly, is concerned with a tool assembly for finishing, that is, sanding and polishing, a bowling ball surface.

2. Description of the Prior Art

On occasion, bowling balls must be refinished by sanding and polishing the outer spherical surface. Oftentimes refinishing is necessary when a bowling ball has changed ownership and the ball's finger holes have been plugged with filler material so that they may be redrilled to match the hand and finger size of the new owner. In these cases the excess plug material must be abraded down to match the bowling ball's original spherical surface. Special care must be taken not to compromise the sphericity of the ball. If the ball is out-of-round its usefulness at the bowling alley will be diminished. Easy to use and inexpensive tools are required so that a person of average technical skill can successfully refinish a bowling ball without sacrificing the ball's sphericity.

One commonly used method for refinishing bowling balls is to use hand-held sand paper which is abraded against the ball in the areas which require attention. Polishing is performed by placing polishing compounds on a rag and rubbing the bowling ball. This operation can be simplified and performed more quickly by placing the bowling ball on a machine which rotates the ball while the sandpaper or polishing rag is introduced to the ball. There are several problems with this method. Uneven hand pressure will decrease the sphericity of the ball. This problem is particularly apparent around plugged finger holes where sanding may be concentrated. Another problem has to do with skin contact with the rubbing compounds which may cause skin irritation. Sanding is sometimes done in water, and skin irritation may result from the mixture of abrasive debris and water.

A more advanced method involves creating a rigid concave pattern of an area of the bowling ball which is to be refinished. To do this, cellophane wrap is placed around the ball and a clay ring dam is built on the cellophane. The dam should enclose an area the size of the rigid concave pattern desired. The dam is then filled with finger hole filler material which is left to harden. After hardening, the rigid filler material pattern is removed from the cellophane. Sandpaper is then placed in the formed spherical depression and the assembly is abraded against the bowling ball. -This device may also be used in conjunction with a ball spinner which will hasten the abrasion process. Using this rigid concave pattern, the ball may be more evenly sanded than if the sandpaper was held by hand, however this method has several drawbacks. First, it is difficult to keep the sandpaper fixed in the spherical depression. Also, the sandpaper tends to wrinkle, decreasing the ball contact area. Furthermore, the pattern is rigid, and therefore does not mate well with all bowling balls, so a new pattern is required for each ball refinished. Finally, the practical size for these patterns is fairly small, thereby limiting the contact area between the sandpaper and the ball.

Mechanical apparatuses designed for grinding and polishing spherical balls are described in U.S. Pat. No. 3,024,578 to Mushkin and U.S. Pat. No. 3,961,448 to Akahane.

The Mushkin device is for grinding the exterior surfaces of spherical balls, especially bowling balls, from rough spherical castings. Two grinding heads, with abrasive conical interior elements into which the ball rests, are angularly disposed on the supporting framework. One grinding head rotates and the other is rotationally stationary, but forced against the ball to keep constant contact. The Akahane apparatus is a polishing device for finishing spheres of hard materials, or production of concave or convex lenses. Three polishing dishes are fixed at the end of three drive shafts which are in the same plane and 120 degrees apart. The rough ball is placed such that all three polishing dishes contact. The dishes rotate, thereby polishing the ball. Both of these apparatuses are designed more for production purposes than for use by the average sportsperson wishing to refinish a bowling ball. Furthermore, these apparatuses are relatively complicated and, if commercially available, would likely require a substantial investment.

Consequently, a need exists for a bowling ball finishing device which is affordable, simple to use and gives consistent and reliable results on any bowling ball without sacrificing sphericity.

SUMMARY OF THE INVENTION

The present invention provides a tool assembly for finishing a spherical surface of a bowling ball being designed to satisfy the aforementioned need. The finishing tool assembly of the present invention includes a tool having a right cylindrical body fabricated from a pliable material, such as urethane. Centered on each of the two opposite faces of the body is a concave-shaped depression described by a portion of a sphere, one concave depression having a chordal length greater than the other. Sanding and polishing disks are provided, being sized to fit the respective concave depressions and cut so to lie substantially flush on the surfaces of the depressions without forming wrinkles. Patches of hook and loop material are fixed respectively on the surfaces of both concave depressions and the back surfaces of the sanding and polishing disks. The patches of hook and loop material thereby provide a method for releasably attaching an abrasion media to the tool. When a concave depression of the tool is placed over a bowling ball surface, and pressure is applied to the tool, the pliability of material of the tool body will allow adaptation of the tool shape to the bowling ball surface, making more conformable contact of the tool on various sizes of bowling balls.

Accordingly, the present invention is directed to a tool assembly for finishing a spherical surface of bowling ball which comprises: (a) a tool having a body fabricated from a pliable material and having at least one face and a concave-shaped depression formed in the face of the body; (b) a first fastening material disposed within and fixed to the surface of the concave depression; and (c) a disk sized to fit in the concave depression and having an abrasive material on a first side of the disk and a second fastening material fixed to a second side of the disk being releasably attachable to the first fastening material on the body such that the disk may be releasably mounted in the concave depression of the body of the tool.

More particularly, the body is solid object being a right cylinder in shape. A pair of concave-shaped depressions are formed in respective opposite faces of the body and disposed in a spaced apart back-to-back relationship to one another. One of the concave depressions has a larger chordal length than the other concave depression. The first fastening material is disposed within and fixed to the surface of each of the concave depressions. Also, a pair of abrasive disks are provided each of different diameter sizes to fit the respective concave depressions.

Each of the disks has a plurality of radial slots defining a plurality of pedals adapting the respective disk to fit flush on the surface of and conform to the shape of the concave-shaped depression in a respective one of the faces of the body. Also, the first and second fastening materials are patches of hook and loop releasable fastening materials.

The present invention also is directed to the tool used for finishing the spherical surface of a bowling ball which comprises: (a) a right cylindrical solid body fabricated from a pliable material and having an axial length and a pair of opposite faces spaced apart by the axial length of the body; and (b) a pair of concave-shaped depressions each formed in a respective one of the opposite faces of the body and disposed in a spaced apart back-to-back relationship to one another, one of the concave depressions having a larger chordal length than the other of the concave depressions. The tool also comprises a fastening material disposed within and fixed to a surface of each of the concave depressions, the fastening material adapting a disk having an abrasive material thereon to be attached to the body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a bowling ball being spun on a conventional ball spinner apparatus while a bowling ball finishing tool assembly of the present invention is being used to finish the spherical surface of the bowling ball.

FIG. 2 is an enlarged diametrical sectional view of the finishing tool assembly taken along line 2—2 of FIG. 1.

FIG. 3 is a perspective view of the finishing tool assembly of the present invention with the polishing and sanding disks removed.

FIG. 4 is a bottom plan view of the finishing tool assembly showing the larger one of two concave depressions on the tool body having the larger one of two patches of hook fastening material thereon.

FIG. 5 is a top plan view of the finishing tool assembly showing the smaller one of the two concave depressions on the tool body having the smaller one of two patch of hook fastening material thereon.

FIG. 6 is a split top and bottom plan view of the larger one of two abrasion disks of the finishing tool assembly showing a patch of loop fastening material on a bottom side of the disk and a layer of abrasive material on a top side, thereof.

FIG. 7 is a split top and bottom plan view of the smaller one of two abrasion disk of the finishing tool assembly showing a patch of loop fastening material on a bottom side of the disk and a layer of abrasive material on a top side thereof.

DETAILED DESCRIPTION OF THE INVENTION

Referring now to the drawings, and more particularly, to FIGS. 1 and 2, there is shown a finishing tool assembly, generally designated 10, which comprises the preferred embodiment of the present invention and is specifically adapted for polishing and sanding a bowling ball B. In FIG. 1, the tool assembly 10 is shown being used to polish or sand the spherical surface S of the bowling ball B as the latter is spun on a conventional ball spinner apparatus 12. While the tool assembly 10 can be used in conjunction with such apparatus 12, it can be equally used as the bowling ball is held and rotated manually.

Basically, the finishing tool assembly 10 includes a tool 14 having a body 16 fabricated from a suitable pliable material, such as urethane. The tool body 16 is preferably solid, a right cylinder in shape, and shorter in axial length than in diameter. Also, the tool body 16 has at least one and preferably a pair of opposite circular faces 16A, 16B being spaced apart by the axial length of the body 16, and a cylindrical peripheral surface 16C extending between the peripheries of the opposite circular faces 16A, 16B such that the opposite faces extend substantially parallel to one another.

Referring to FIGS. 2–5, the tool body 16 also has at least one and preferably a pair of concave-shaped depressions 18, 20 centrally located on and formed in the respective opposite faces 16A, 16B of the body and disposed in a spaced apart back-to-back relationship to one another. The one concave-shaped depression 18 has a larger chordal length and axial depth than the other concave-shaped depression 20. Both concave-shaped depressions 18, 20 are described by spherical radii, which can be different or the same, and constitute portions of a sphere.

The finishing tool assembly 10 also includes a first fastening material 22 disposed within and fixed to the respective surface 24, 26 of each of the concave-shaped depressions 18, 20 and a pair of flexible disks 28, 30 each being of a diameter size adapted to fit in a respective one of the respective depressions 18, 20. Each disk 28, 30 is fabricated of a suitable flat sheet of material, such as paper, and has an abrasive material 32 applied on a first or top side thereof and a second fastening material 34 applied on and fixed to a second or bottom side of the respective disk 28, 30. The second fastening material 34 is releasably attachable to the first fastening material 22 such that the respective disk 28, 30 can be releasably mounted in the respective one of the concave-shaped depressions 18, 20 of the body 16. Preferably, the first and second fastening materials 22, 34 are patches of hook and loop fastening materials, which are commercially available under the trademark Velcro.

Referring to FIGS. 2, 6 and 7, the abrasive materials 32 provided on the top surfaces of the large and small diameter disks 28, 30 are adapted to perform the particular task desired. Thus, the abrasive material 32 on some of the disks 28, 30 will be any material suitable to polish the bowling ball surface S, while the abrasive material 32 on others of the disks 28, 30 will be any material suitable to sand the bowling ball surface S. The abrasive materials can be of various roughnesses such that a disk with a rougher material may be used initially, and as the bowling ball surface S is abraded, then a disk with finer abrasive materials may be substituted.

The disks 28, 30 and fastening material 22, 34 will have different diameter sizes for fitting the different diameter-sized depressions 18, 20. Also, each of the disks 28, 30 and fastening material 22, 34 has a plurality of radial slots 36, 38 defining a plurality of pedals 40, 42 for example six, which adapt the respective disks 28, 30 and fastening material 22, 34 to fit flush on the respective surface 24, 26 of the depression 18, 20 and conform to the shape thereof.

Because of the pliable nature of the tool body 16 it will conform to the surface S of the bowling ball B even if there is a slight mismatch between the spherical radii of the bowling ball B and the concave-shaped depressions 18, 20. Furthermore, the different sized concave-shaped depressions 18, 20 allow for larger or smaller surfaces S of bowling balls B to be abraded.

It is through that the present invention and many of its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. A tool assembly for finishing a spherical surface of a bowling ball, comprising:

(a) a tool having a body fabricated from a pliable material, said body having a pair of opposite faces and a pair of concave-shaped depressions each formed in a respective one of said opposite faces of said body, one of said concave-shaped depressions having a larger chordal length than the other of said concave-shaped depressions;

(b) a first fastening material disposed within and fixed to a surface of each of said concave-shaped depressions; and (c) a pair of flexible disks each being of a size adapted to fit in a respective one of said concave-shaped depressions and having an abrasive material on a first side of said disk and a second fastening material fixed to a second side of said disk being releasably attachable to said first fastening material such that said disk may be releasably mounted to said surface of and within said respective one of said concave-shaped depressions of said body.

2. The tool assembly of claim 1 wherein said body of said tool is solid and a right cylinder in shape, said body being shorter in axial length than in diameter.

3. The tool assembly of claim 1 wherein said body of said tool has a cylindrical peripheral surface, each of said concave-shaped depressions being centrally located on said respective one of said faces of said body.

4. The tool assembly of claim 1 wherein each said concave-shaped depression in said body of said tool is described by a spherical radius and constitutes a portion of a sphere.

5. The tool assembly of claim 1 wherein said abrasive material on said disk is a material adapted to polish a bowling ball surface.

6. The tool assembly of claim 1 wherein said abrasive material on said disk is a material adapted to sand a bowling ball surface.

7. The tool assembly of claim 1 wherein said disk has a plurality of radial slots defining a plurality of pedals adapting said dish to fit flush on said surface of and conform to the shape of each said concave-shaped depression in said faces of said body.

8. The tool assembly of claim 1 wherein said first and second fastening materials are patches of hook and loop fastening materials.

9. A tool assembly for finishing a spherical surface of a bowling ball, comprising:

(a) a tool having a solid body fabricated from a pliable material, said body having an axial length and a pair of opposite faces spaced apart by said axial length of said body, said body also having a pair of concave-shaped depressions each formed in a respective one of said opposite faces of said body and disposed in a spaced apart back-to-back relationship to one another, one of said concave-shaped depressions having a larger chordal length than the other of said concave-shaped depressions;

(b) a first fastening material disposed within and fixed to a surface of each of said concave-shaped depressions; and (c) a pair of flexible disks each being of a size adapted to fit in a respective one of said respective concave-shaped depressions and having an abrasive material on a first side of said disk and a second fastening material fixed to a second side of said disk being releasably attachable to said first fastening material such that said disk may be releasably mounted in said respective one of said concave-shaped depressions of said body.

10. The tool assembly as recited in claim 9, wherein said concave-shaped depressions are described by spherical radii and constitute a portion of a sphere.

11. The tool assembly of claim 9 wherein said body of said tool is solid and a right cylinder in shape, said body being shorter in axial length than in diameter.

12. The tool assembly of claim 9 wherein said body of said tool has a cylindrical peripheral surface and said pair of opposite faces extend substantially parallel to one another, said concave-shaped depressions being centrally located on said faces of said body.

13. The tool assembly of claim 9 wherein said abrasive material on at least one of said disks is a material adapted to polish a bowling ball surface.

14. The tool assembly of claim 9 wherein said abrasive material on at least one of said disks is a material adapted to sand a bowling ball surface.

15. The tool assembly of claim 9 wherein said disks are of different diameter sizes.

16. The tool assembly of claim 9 wherein each of said disks has a plurality of radial slots defining a plurality of pedals adapting said disk to fit flush on said surface of and conform to the shape of said concave-shaped depression in a respective one of said faces of said body.

17. The tool assembly of claim 9 wherein said first and second fastening materials are patches of hook and loop fastening materials.

18. A tool for use with a disk having an abrasive material for finishing a spherical surface of a bowling ball, comprising:

(a) a right cylindrical solid body fabricated from a pliable material and having an axial length and a pair of opposite faces spaced apart by said axial length of said body; and (b) a pair of concave-shaped depressions each formed in a respective one of said opposite faces of said body and disposed in a spaced apart back-to-back relationship to one another, one of said concave-shaped depressions having a larger chordal length than the other of said concave-shaped depressions.

19. The tool of claim 18 further comprising:

a fastening material disposed within and fixed to a surface of each of said concave-shaped depressions, said fastening material adapting a disk having an abrasive material thereon to be attached to said body.

20. The tool of claim 18 wherein said body is shorter in axial length than in diameter.

21. The tool of claim 18 wherein said concave-shaped depressions are centrally located on said opposite faces of said body.

22. The tool of claim 18 wherein each of said concave-shaped depression in said body is described by a spherical radius and constitutes a portion of a sphere.

* * * * *